US010301813B1

(12) United States Patent
Hawkins

(10) Patent No.: US 10,301,813 B1
(45) Date of Patent: May 28, 2019

(54) PORTABLE CORE FACILITY FOR A BUILDING

(71) Applicant: John P. Hawkins, Roslyn, NY (US)

(72) Inventor: John P. Hawkins, Roslyn, NY (US)

( * ) Notice: Subject to any disclaimer, the term of this patent is extended or adjusted under 35 U.S.C. 154(b) by 0 days.

(21) Appl. No.: 15/800,056

(22) Filed: Oct. 31, 2017

Related U.S. Application Data

(60) Provisional application No. 62/415,185, filed on Oct. 31, 2016.

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |
| ***E04B 1/348*** | (2006.01) |
| ***E04B 1/343*** | (2006.01) |
| ***E04B 2/70*** | (2006.01) |
| ***E04B 1/35*** | (2006.01) |
| *E04H 9/14* | (2006.01) |

(52) U.S. Cl.
CPC ..... *E04B 1/34815* (2013.01); *E04B 1/34336* (2013.01); *E04B 1/34869* (2013.01); *E04B 1/35* (2013.01); *E04B 2/70* (2013.01); *E04B 2001/3577* (2013.01); *E04H 9/14* (2013.01)

(58) Field of Classification Search
CPC ..... E04B 1/34815; E04B 1/34336; E04B 1/34869; E04B 2/70; E04B 2001/3577; E04H 9/14
See application file for complete search history.

(56) References Cited

U.S. PATENT DOCUMENTS

| | | | | |
|---|---|---|---|---|
| 3,507,081 | A * | 4/1970 | Gallup | G01C 15/06 428/626 |
| 5,127,201 | A * | 7/1992 | Skvaril | E03C 1/01 52/236.6 |
| 8,621,787 | B2 * | 1/2014 | Barry | E04B 1/34869 52/220.1 |
| 2009/0301001 | A1 * | 12/2009 | Kish | C09K 21/14 52/105 |
| 2010/0024352 | A1 * | 2/2010 | Pope | E04B 1/3431 52/745.02 |
| 2011/0041415 | A1 * | 2/2011 | Esposito | E04B 1/34331 52/12 |
| 2011/0056147 | A1 * | 3/2011 | Beaudet | E04B 1/3483 52/79.9 |

(Continued)

*Primary Examiner* — Brian D Mattei
(74) *Attorney, Agent, or Firm* — Dickinson Wright PLLC; Kristopher Lance Anderson

(57) ABSTRACT

A prefabricated building module constructed at a central location and delivered to a construction site via shipping using the intermodal freight transport system and having cold formed wood bracing walls to resist forces in shear and uplift while providing a continuous load path to the foundation system. The module may include interior walls to section the module into rooms and further comprises mechanical, electrical, utility and plumbing aspects of a building, capable of inspection and certification prior to delivery to the construction site. Once arrived at the construction site the building module is anchored to the building foundation and the remainder of the house is built around the building module.

13 Claims, 10 Drawing Sheets

(56) References Cited

U.S. PATENT DOCUMENTS

| | | | | |
|---|---|---|---|---|
| 2011/0219708 | A1* | 9/2011 | Ohnishi | E04B 1/3483 52/79.1 |
| 2011/0283656 | A1* | 11/2011 | Faber | E04H 1/02 52/745.13 |
| 2013/0014451 | A1* | 1/2013 | Russell | E04B 1/34869 52/79.1 |
| 2015/0240475 | A1* | 8/2015 | Malakauskas | E04B 1/34838 52/79.13 |
| 2015/0300321 | A1* | 10/2015 | Haar | F03D 3/005 206/223 |
| 2016/0160515 | A1* | 6/2016 | Wallance | E04B 1/3483 52/79.1 |
| 2018/0161611 | A1* | 6/2018 | Burkett | E04B 1/343 |
| 2018/0195266 | A1* | 7/2018 | Arakane | E04B 1/348 |
| 2018/0230690 | A1* | 8/2018 | Leibinger | E04H 3/08 |

* cited by examiner

PORTABLE CORE FACILITY FOR A BUILDING

This application includes material that is subject to copyright protection. The copyright owner has no objection to the facsimile reproduction by anyone of the patent disclosure, as it appears in the Patent and Trademark Office files or records, but otherwise reserves all copyright rights whatsoever.

CROSS-REFERENCE TO RELATED APPLICATIONS

This application claims priority to U.S. Provisional Patent Application Ser. No. 62/415,185, filed on Oct. 31, 2016, entitled "SYSTEM AND METHOD FOR A PORTABLE CORE FACILITY FOR A BUILDING" of which is hereby incorporated herein by reference in its entirety for all purposes.

BACKGROUND OF THE INVENTION

1. Field of the Invention

The present invention relates in general to the field of building assembly. In particular, the present invention relates to pre-fabricated portable core facilities for buildings, including habitable dwellings.

2. Description of the Prior Art

Prior to circa 1860 a house (or any other building type) essentially contained no systems. There was no electric light or central heat or air conditioning, and only the grandest homes might have a bath. These systems were developed in the later 19th century and were layered on the basic structure, which before then contained simple rooms—bare spaces that could serve any function. There were no bathrooms or mechanical rooms or laundry rooms. Examining old houses one often finds that there are no basements or cellars, and that a cellar was only excavated when the opportunity arose to install plumbing and heating. Each system developed separately; and each became a separate trade.

In modern housing construction, there are still separate trades, which work in the bathrooms and mechanical/utility rooms of every new building. One result is that the plumber, the electrician and the HVAC contractor all compete to incorporate their part of the work into a confined space—whether the mechanical room or the framed wet-wall of a bathroom—without regard for the competing demands of the other trades. This also is reflected in the model building codes and in the inspections of new construction. There exists a National Electrical Code, and several model building Codes—the Uniform Building Code (UBC) or the International Building Code (IBC)—each with an embedded plumbing code and a fuel gas code. Meanwhile in new construction the builder or main contractor must separately schedule a framing inspection, and an inspection of the rough plumbing and the rough electric, and sometimes of insulation, and then final inspections. This arrangement has accreted over time and requires careful coordination and adds time and expense to construction.

In the aftermath of Hurricane Andrew and other catastrophic weather events, greater attention has been given to lateral and uplift loads by the model building codes, which now require increased strength in high wind events, resulting in greater use of a wide variety of straps and ties to provide that strength against uplift and lateral forces.

Throughout the development of modern residential construction, efforts to create modular or mobile homes have continued. Ranging from recreational vehicles to manufactured homes, the efficiencies of having a home built and then moved to a site has been considered an approach to reducing the cost of building on site. Another recent development has been the incorporation of intermodal shipping containers in the context of creating habitable enclosures, including for multi-family housing units or portable housing. However, many of these developments require the use of the structural container itself, including the floor, walls, and roof assemblies. Although manufactured housing and modular housing and even shipping container housing are all options, they are all inferior solutions. The market does not want to live inside a shipping container. Most people prefer that their homes do not look like shipping containers. The market expects rooms to be greater than 8 feet in width, but anything over 102 inches is an oversize load for purposes of portability. Permits can be had to ship oversize loads, but the rules vary by state, and there is a final limit to the size. The expense of shipping oversize loads restricts the market for modular and manufactured housing.

Further, while these technological advances have allowed for use of modular building systems, there remains a need in the art for modular systems which are portable, yet functional (i.e. compatible with) within a traditionally built habitable building.

SUMMARY OF THE INVENTION

The present invention addresses failings in the art by providing a system and method for a pre-manufactured unit to be incorporated into new buildings which comprises the labor- and skill-intensive aspects of a building—the kitchen, bathroom, mechanical room, and utilities. In one aspect, the skilled trade work moves from the construction site into a factory, putting the bathrooms and mechanical systems into a manufactured unit, and shipping a finished module using the existing systems and infra-structure of the inter-modal container industry. The present invention is analogous to a domestic appliance and will be submitted for code approval, and a UL listing. It is an objective of the present invention to address speed of construction, simplify worksite scheduling and coordination, and provide a higher quality product at lower cost.

The existing prior art does not take advantage of the potential to build a stronger core facility in the factory setting, which includes the use of epoxy and presses to assemble the facility thus providing the additional strength to the entire structure when the surrounding construction is attached to the core facility. The core facility of the present invention that holds the notional product—a bathroom and utility room—is not just a container: it is four braced shear walls, with a roof/ceiling diaphragm, able to furnish a significant amount of the wall bracing required under § R602 of the ICC Residential Code.

In one aspect of the present invention, the system having a frame assembly will be anchored to the foundation, and the building will then be framed around it. The present invention may be a secure, weather-tight unit as shipped. The exterior will permit the use of common framing connectors with ordinary nails and/or screws commonly used in the trade for attaching traditional stick framing to the top and sides allowing the building to use the strength of the frame for resistance against shear, lateral and uplift loads. In the event of a severe weather event—tornado or hurricane—the enclaves or rooms within the present invention provide a place of refuge.

The system of the present invention is not designed to provide habitable space as is defined in building codes. By providing the most complex portions of a building in a single unit manufactured and assembled in a controlled environment (i.e. not at the construction site), flexibility with time allocation and cost savings are realized while preserving the inherent advantages of modern stick construction.

In one aspect, the present invention provides a portable core facility for a building, comprising a mechanical room, a kitchen, an electrical panel, and one or more bathrooms configured within said portable core facility or adjacent to the portable core facility, wherein said portable core facility further comprises corner castings in accordance with standard intermodal shipping containers capable of being transported by the existing intermodal system from a manufacturing facility to a construction site and anchored, via said corner castings, to a foundation system, a roof or floor diaphragm, or bracing walls so as to resist forces in shear and uplift while providing a continuous load path to the foundation system.

In another aspect, the present invention provides a system, comprising a portable core facility for a building, further comprising one or more components selected from the group consisting of: a mechanical room or a utility room, a kitchen, an electrical panel, and a bathroom facility, said portable core facility comprising corner castings for transportation via intermodal freight transport, transportation of the portable core facility pre-manufactured at a manufacturing site via intermodal freight transport to a construction site and anchoring of the portable core facility, via said corner castings or other means known in the art, to a foundation system, a roof or floor diaphragm, or bracing walls so as to resist forces in shear and uplift while providing a continuous load path to the foundation system.

It is therefore an object of the present invention to present a system and method for fabricating a house using a portable core facility comprising the steps of; combining a plurality of bracing walls into a building module to form a generally rectangular shape, inserting an interior wall into the building module to define a utility room, inserting an interior wall into the building module to define a kitchen, inserting an interior wall into the building module to define a bathroom, attaching framing connectors to the exterior of the outer walls for attaching traditional stick framing to the outer wall for resistance, installing corner castings at the corners of the building module for moving the building module to a construction site, transporting the building module to a building site, constructing a foundation at a building site for receiving the building module and adjacent structures of the house, moving and positioning the building module onto the foundation, anchoring the corner castings to a foundation system, and constructing and attaching the stick framing to create additional rooms of the house.

In one aspect, the system further comprises cold forming a plurality of bracing walls by: sawing wood into strips, planing the strips to a thickness that is even, stacking the strips, alternating every other strip end for end to reverse the slope of the grain, spreading a thin layer of adhesive on the face of a first strip, laying a second strip on top of the first strip, spreading adhesive on the second strip and adding a third strip to the adhesive, and inserting an bracing wall into a clamping press to compress and dry.

In another aspect, the system comprises forming one or more shear walls from one or more of the plurality of bracing walls.

It is another object of the present invention to provide a portable core facility having a utility room comprising components selected from a group consisting of: an electrical system, communication systems, one or more hot water heaters, an HVAC system, a water purification system, a washing machine, a dryer, and a utility tub and sink.

It is another object of the present invention to provide a portable core facility having a kitchen further comprising components selected from a group consisting of: a stove, a refrigerator, a microwave oven, a dishwasher into the kitchen, and a counter and cabinets.

It is another object of the present invention to provide a portable core facility having a bathroom further comprising components selected from a group consisting of: a bidet, a tub, a shower and a sink.

In one aspect, the system of the present invention comprises attaching a UL Certified Mark and Barcode to the building module for identification. In another aspect the system comprises certifying the building module to building codes and standards of the country that the building module will be shipped to.

It is another object of the present invention to provide a portable core facility for a building, comprising: one or more mechanical rooms; one or more kitchens; one or more electrical panels; and one or more bathrooms configured within said portable core facility or adjacent to the portable core facility; wherein said portable core facility further comprises: a plurality of bracing walls into a building module to form a generally rectangular shape; and corner castings attached to upper and lower corners of the portable core facility in accordance with standard intermodal shipping containers capable of being transported by the existing intermodal system from a manufacturing facility to a construction site and anchored, via said corner castings or alternate means, to a foundation system, a roof or floor diaphragm, or bracing walls so as to resist forces in shear and uplift while providing a continuous load path to the foundation system.

In one aspect the bracing walls comprise cold formed bracing walls.

The invention in its broadest aspect presents a modular portable core facility capable of utilizing intermodal freight transport, while further comprising shear resistance via the use of multiple features, including but not limited to, corner castings having steel connector systems, cold-formed bracing, and associated timber rails for anchoring said portable core facility to the foundation, roof diaphragm, floor diaphragm and other bracing walls.

The details of one or more embodiments of the present invention are set forth in the accompanying drawings and description below. Other aspects, features and advantages will be apparent from the description and drawings.

BRIEF DESCRIPTION OF THE DRAWINGS

The foregoing and other objects, features, and advantages of the disclosure will be apparent from the following description of embodiments as illustrated in the accompanying figures and drawings.

DESCRIPTION OF THE ENABLING EMBODIMENT

Figure 1:
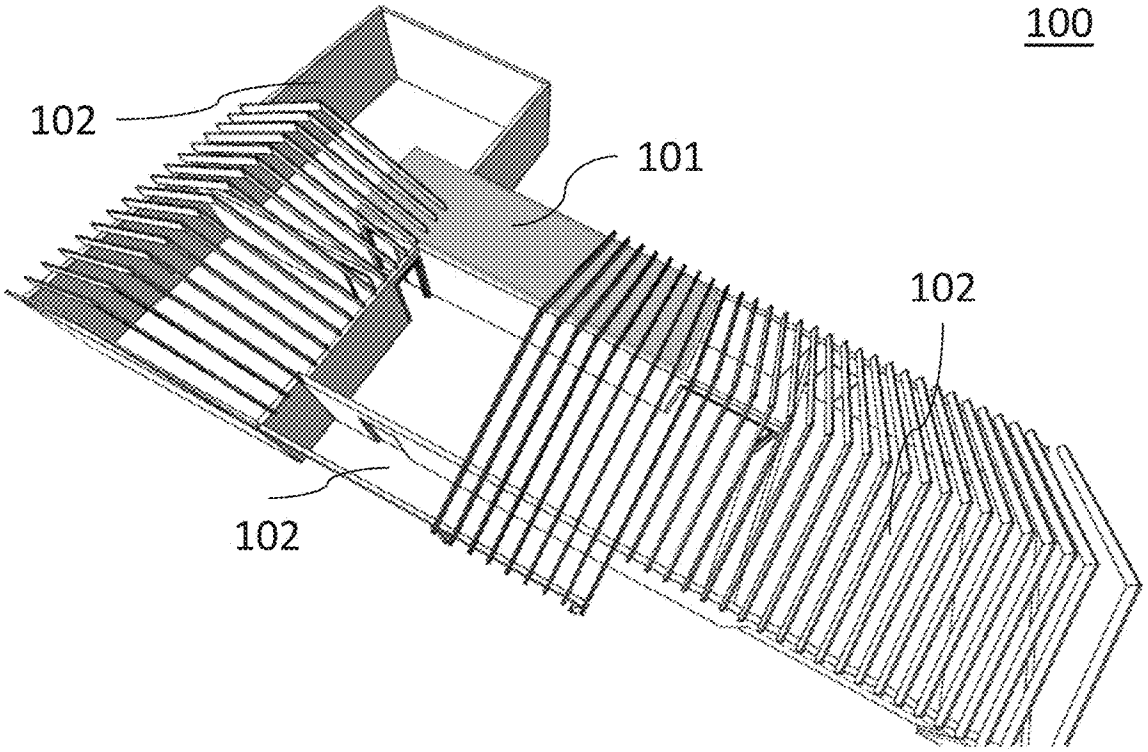
FIG. 1 depicts a three-view perspective of a core facility positioned within a conventionally framed structure.

While the making and using of various embodiments of the present invention are discussed in detail below, it should be appreciated that the present invention provides many applicable inventive concepts that can be embodied in a wide variety of specific contexts, goods, or services. The specific embodiments discussed herein are merely illustrative of specific ways to make and use the disclosure and do not delimit the scope of the disclosure.

All publications and patent applications mentioned in the specification are indicative of the level of skill of those skilled in the art to which this disclosure pertains. All publications and patent applications are herein incorporated by reference to the same extent as if each individual publication or patent application was specifically and individually indicated to be incorporated by reference.

The present invention will now be described more fully hereinafter with reference to the accompanying figures and drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, compositions, processes, or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

For the purposes of the present invention, a core facility system is presented which is capable of being pre-manufactured according to a specification for a building. The core facility is constructed at a manufacturing site, where skilled trades may construct the core facility in a centralized location, resulting in increased efficiency. The core facility is constructed to take advantage of the intermodal freight transport system, similar to shipping containers, although the present invention does not convert or modify shipping containers. Despite not using actual shipping containers, the present invention takes advantage of corner castings in accordance with standard intermodal shipping containers in order to provide the capability of being transported by the existing intermodal system from a manufacturing facility to a construction site. The resulting core facility as delivered to the construction site may be attached to both a foundation system and roof or floor diaphragm, and/or bracing walls so as to resist forces in shear and uplift and provide a continuous load path to the foundation.

In one embodiment the present invention utilizes customary construction techniques known in the art for building construction, and may refer to certain construction standards as set forth herein. Unless otherwise further defined herein, terms shall be defined by the International Building Code (IBC) § 202 and International Residential Code (IRC) § 202, as may be further referenced to other code publications by the International Code Council (ICC), all of which are incorporated by reference in their entirety. Further incorporated herein is the 2015 Wood Frame Construction Manual (WFCM) for One- and Two-Family Dwellings, developed by the American Wood Council's (AWC) Wood Design Standards Committee as may be referenced in the 2015 International Building Code and 2015 International Residential Code. In the event of an inconsistency of such publications and the present invention, the defined terms of the present invention shall prevail.

For the purposes of the present invention "habitable space" is defined as a space in a building for living, sleeping, eating or cooking, or used as a home occupation. Bathrooms, toilet rooms, closets, halls, storage or utility spaces and similar areas are not considered habitable spaces.

The IBC further defines "manufactured home", "mobile home" and "modular home" all of which are factory manufactured "dwelling units" (IRC, § R202). The system of the present invention may be referred to as a "core facility". A core facility will not be a "dwelling unit" and except for the possible inclusion of kitchen facilities, will not contain any "habitable spaces".

For the purposes of the present invention a "mechanical room" or a "utility room" is a room or space in a building or dwelling unit dedicated to the mechanical equipment and its associated electrical equipment, as opposed to rooms intended for human occupancy or storage. Unless a building is served by a centralized heating plant, the size of the mechanical room is usually proportional to the size of the building. The mechanical room may include, but is not limited to, an electrical panel, hot water heater, furnace or boiler, air handler, HVAC equipment, telephone or internet connections and equipment, water service, house traps, utilities such as a washer and dryer, water purification systems, utility tub and sink, and the like.

For the purposes of the present invention a "kitchen" is a room or part of a room used for, or designated to be used for, preparation of food. A kitchen is typically equipped with a stove, a sink with hot and cold running water, a refrigerator, counters and kitchen cabinets arranged according to a modular design. Many households have a microwave oven, a dishwasher and other electric appliances. The main function of a kitchen is serving as a location for storing, cooking and preparing food (and doing related tasks such as dishwashing), but it may also be used for dining, entertaining and laundry.

For the purposes of the present invention an "electrical panel" refers to a distribution board (also known as panelboard, breaker panel, or electric panel), which is a component of an electricity supply system that divides an electrical power feed into subsidiary circuits, while providing a protective fuse or circuit breaker for each circuit in a common enclosure. Normally, a main switch, and also one or more residual-current devices (RCD) or residual current breakers with overcurrent protection (RCBO), may also be incorporated.

For the purposes of the present invention a "bathroom" refers to a room comprising one or more of: a bidet, water closet, lavatory, tub or shower, all of which are located together on the same floor level.

For the purposes of the present invention "corner castings" refer to a standardized connector for securing intermodal shipping containers, primarily used for locking an intermodal container in place on a container ship, semitrailer truck, or railway train, and for lifting of the intermodal shipping container by container cranes and/or sidelifters.

For the purposes of the present invention "intermodal shipping containers" refer to a large standardized shipping container, designed and built for intermodal freight transport, meaning these containers can be used across different modes of transport—from ship to rail to truck—without unloading and reloading their cargo. These containers are known under a number of names, such as simply container, cargo or freight container, ISO container, shipping, sea or ocean container, container van or (Conex) box, sea or c-can.

For the purposes of the present invention "intermodal freight transport" or "intermodal system" refers to (interchangeably) as the transportation of freight in an intermodal container or vehicle, using multiple modes of transportation (rail, ship, and truck), without any handling of the freight itself when changing modes.

For the purposes of the present invention a "foundation" system refers to the lowest load-bearing part of a building, typically below ground level. A foundation may be comprised of a steel, wood, stone or concrete structure that supports a building from underneath.

For the purposes of the present invention a "diaphragm" refers to a horizontal or nearly horizontal system acting to transmit lateral forces to the vertical elements. Diaphragm also includes horizontal bracing systems. A "roof diaphragm" refers to a diaphragm that is located above a room or facility. A "floor diaphragm" refers to a diaphragm that is located at the base, or below the floor of a room or facility.

For the purposes of the present invention "bracing walls" or "braced wall panels" refer to a full-height section of wall constructed to resist in-plane shear loads through interaction of framing members, sheathing materials, and anchors, such as corner castings. The bracing walls are cold-formed wood which increases the strength and stiffness of the wall. Cold-forming is a composite method of building that uses two or more layers of thin wood, called veneers, oriented in different directions, resulting in a strong monocoque structure. Using different types of wood, the builder can lighten some areas and strengthen other high-stress areas. The cold-formed bracing walls can also have an extra layer of protection either inside or out or both with materials, such as, woven or knitted fiberglass cloth, carbon fiber or kevlar cloth, rigid foam insulation, aluminum honeycomb, or sheet metal, for impact resistance, especially when lightweight, soft timber such as cedar is used. This method lends itself to great flexibility in protection from storms and bad weather. A "shear wall" is a bracing wall designed and constructed to resist racking from seismic and wind by use of masonry, concrete, steel or wood framing in accordance with Chapter 6 of the IRC and associated with limitations of section R301.2 of the IRC.

As further referenced in the IBC and IRC, the terms "self-contained equipment" and "shear wall", also in the structural design chapter 16, § 1609.1.3, Anchorage against overturning, uplift and sliding, the core facility is a piece of self-contained equipment, neither a modular nor a manufactured home, which incorporates shear walls and frames that become an integral part of a buildings structure and provide resistance against wind-induced overturning, uplift and sliding and provide continuous load paths for these forces to the foundation. For the purposes of the present invention, "equipment" means piping, ducts, vents, control devices, and other components of systems other than appliances that are permanently installed and integrated to provide control of conditions for buildings.

Turning to the present invention, a preferred embodiment comprises a core facility comprising bracing walls which contains one or more of a mechanical room, kitchen and bathroom, such facility capable of intermodal transport as is a standardized intermodal shipping container. The present invention further comprises an assembly that contains the primary functional systems of a dwelling or building, including electrical, plumbing, and related mechanical/utility systems. The core facility allows for design, construction, and testing/inspection off-site, prior to shipping to a desired construction site. Upon delivery, the core facility is fastened—or anchored—to the building foundation, and can be further utilized as a storm resistant, shear resistant, load-bearing part of the building's structure. Once the core facility is anchored to the foundation, the habitable spaces of the building may then be constructed around the core facility. While the core facility conforms to the dimensions of a traditional shipping container primarily for ease of shipping via intermodal system, it avoids the need for modification or retrofitting of a shipping container as is typically done for container housing. The core facility of the present invention is capable of being constructed by typical means known in the art, including, but not limited to: concrete block/masonry unit (CMU) construction, stone masonry, glass construction, iron and steel, and wood building, including log and timber framed buildings as may be further described in the *Wood Frame Construction Manual*, incorporated herein in its entirety.

The present invention allows for the most complex aspects of a building to be addressed separately from the construction site, resulting in significant time and economic efficiency, particularly in rural areas where skilled tradesmen are scarce or must travel large distances.

In an exemplary embodiment, the present invention may contain bathrooms and mechanical/utility room for a residence. In another embodiment the present invention contains a kitchen, bathroom and mechanical/utility room, and in another embodiment the present invention contains the public restrooms and utility room for a convenience store. Another embodiment includes two core facilities, one containing restrooms and a utility room and the other a complete commercial kitchen for a commercial restaurant, with all aspects pre-approved by the health department prior to delivery to the construction site.

The present invention is constructed to utilize the intermodal freight transport system, thus being designed in accordance with intermodal shipping container specifications, although shipping containers themselves are not used with the present invention. The core facility utilizes engineered framing and bracing systems in accordance with intermodal system specifications, including use of corner castings for use during transport and for affixing the core facility to the building foundation, floor diaphragm, and/or roof diaphragm. Typical shipping containers are overbuilt and costly to reconfigure to satisfy the requirements of the present invention, including removal of doors, forklift flooring, and the like, some of which are subjected to chemical treatments. Such approaches are also incompatible with the prevailing trade practices dominant in wood-frame home construction in most developed nations. Bracing systems may include ex-cross bracing internally with the core facility and may be made with or without external walls.

In another embodiment, the core facility of the present invention is made of standard construction materials. During the construction of the core facility a single location is utilized, allowing for multiple skills to access and service the construction of the core facility. Rather than having the skilled trade workers, such as plumbing, electrical, etc., travel to a construction site for a building, the present invention may be constructed at a central location, where multiple core facilities may be built at a single location, allowing for efficiencies in organizing the various skilled trade worker requirements. Further, certifications and inspections may take place at the manufacturing site rather than the remote construction site, resulting in pre-inspected core facilities which are then capable of delivery to the construction site.

By utilizing the intermodal freight transport infrastructure, core facilities of the present invention may be made by workers in a single location according to desired specifications, and then shipped to the desired construction site. Standard corner castings allow for fastening to occur in accordance with standard intermodal freight transport, and subsequently anchored to the building foundation and roof assemblies, such as the roof diaphragm and/or bracing walls. In one embodiment, traditional anchoring is utilized, including those common in the construction industry such as anchor bolts or welding as a fitment. Such anchoring may include anchors, ties and straps typically utilized in the construction arts, including but not limited to: screw ties for metal stud construction, Simpson joist anchors, framing straps, wing nut anchors, dovetail anchors, seismic notch (seismic code compliant) anchors, brick ties, channel slot anchors, tie and plate anchors, wire anchors, notch anchors, interlock anchors, and the like. In another embodiment, a twist-lock configuration standard in intermodal system may be utilized as the actual anchor. In another embodiment, a modified twist-lock configuration is utilized where the connector is affixed to a reinforcing bar cage for incorporating into the foundation immediately prior to or prior to curing of the foundation pour. In another embodiment, weld plates are set in the foundation concrete for welding the core facility to the foundation. In another embodiment, anchor bolts which are spatially located down the length of the core facility framing are used to bolt the core facility to the foundation. The resulting core facility further provides a pre-fabricated core facility that is tornado and storm resistant, providing required resistance to uplift and lateral forces.

Certain embodiments will now be described in greater detail with reference to the figures. Referencing FIG. 1, the system of the present invention comprises a core facility which is pre-fabricated and shipped to a construction site via intermodal freight transport for incorporation into a building 100. The bracing walls or outer walls of the core facility 101 are cold formed. The core facility 101 is positioned onto a foundation and secured via anchoring systems such as corner castings utilized in the context of intermodal freight transport. The remainder of the building, including habitable space 102 is then constructed as is typical in the art. The core facility 101 may comprise modules for key features of the building, such as one or more bathrooms, a kitchen, and mechanical room. The core facility 101 is further capable of being fastened to roof assemblies as well, allowing for improved shear resistance.

Figure 2:
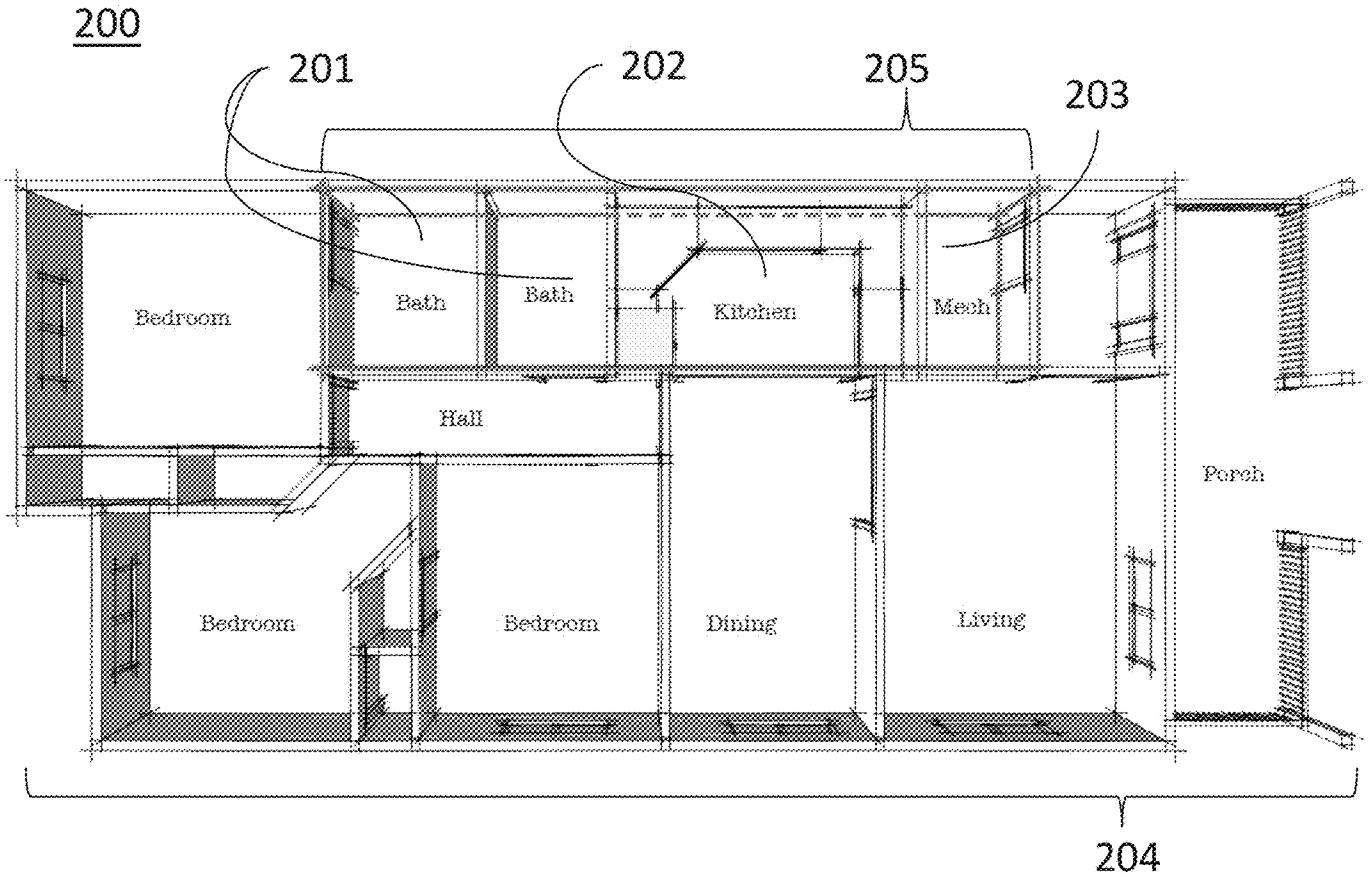
FIG. 2 depicts a top plan view of a building having a core facility of the present invention.

FIG. 2 provides a top plan view of an entire building 200, including the core facility of the present invention 205. Referencing FIG. 2, the core facility 205 comprises the critical functioning portions of a building, typically deemed to not be habitable space, with the exception of the kitchen module 202. The core facility 205 may comprise one or more bathroom modules 201, a kitchen module 202 and a mechanical or utility module 203, each designed in accordance with the specifications of the constructor. The core facility 205 is constructed off-site at a manufacturing facility, and shipped via intermodal transport to the building construction site. The core facility 205 is then fastened to the building foundation via anchor systems, including corner castings which may be used interchangeably with the intermodal freight transport. Once fastened to the foundation, the remaining structure of the building, including habitable space 204, is constructed. Much of the habitable space 204 may comprise non-mechanical aspects, which are less expensive and time consuming to build.

The exemplary embodiment of FIG. 2 is non-limiting, and other modules may include, but are not limited to: a utility room, an electrical system in the utility room, a communication system into the utility room, a hot water heater in the utility room, an HVAC system in the utility room, a water purification system in the utility room, a washing machine in the utility room, a dryer in the utility room, a utility tub and sink in the utility room, an interior wall in the building module to define a kitchen, a stove in the kitchen, a refrigerator in the kitchen, a microwave oven in the kitchen, a dishwasher in the kitchen, a counter and cabinets in the kitchen, an interior wall into the building module to define a bathroom, a bidet in the bathroom, a tub in the bathroom, a shower in the bathroom, and a sink in the bathroom.

Figure 3:
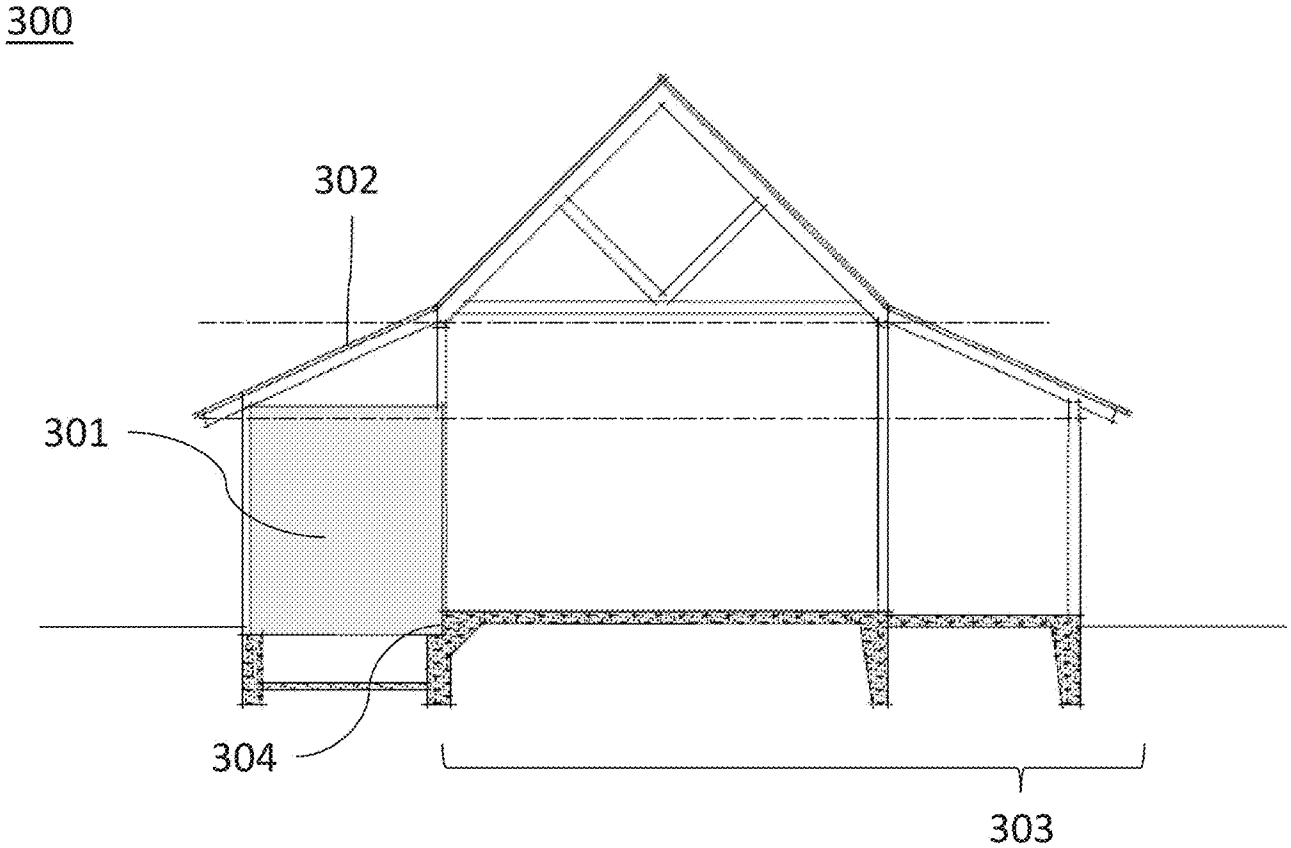
FIG. 3 depicts a cross-section elevational view of the system of the present invention within a building.

Referencing FIG. 3 an exemplary core facility 301 is positioned within a building 300. The remaining habitable space 303 is constructed around the anchored core facility 301, including roofing 302, which may be further fastened to the core facility 301. The core facility 301 may be sunk into the foundation 304 to allow for the core facility's 301 floor diaphragm to contain stubbed utilities, such as water, electricity, and internet/phone connections, to then be connected to the remainder of the building 303.

Figure 4:
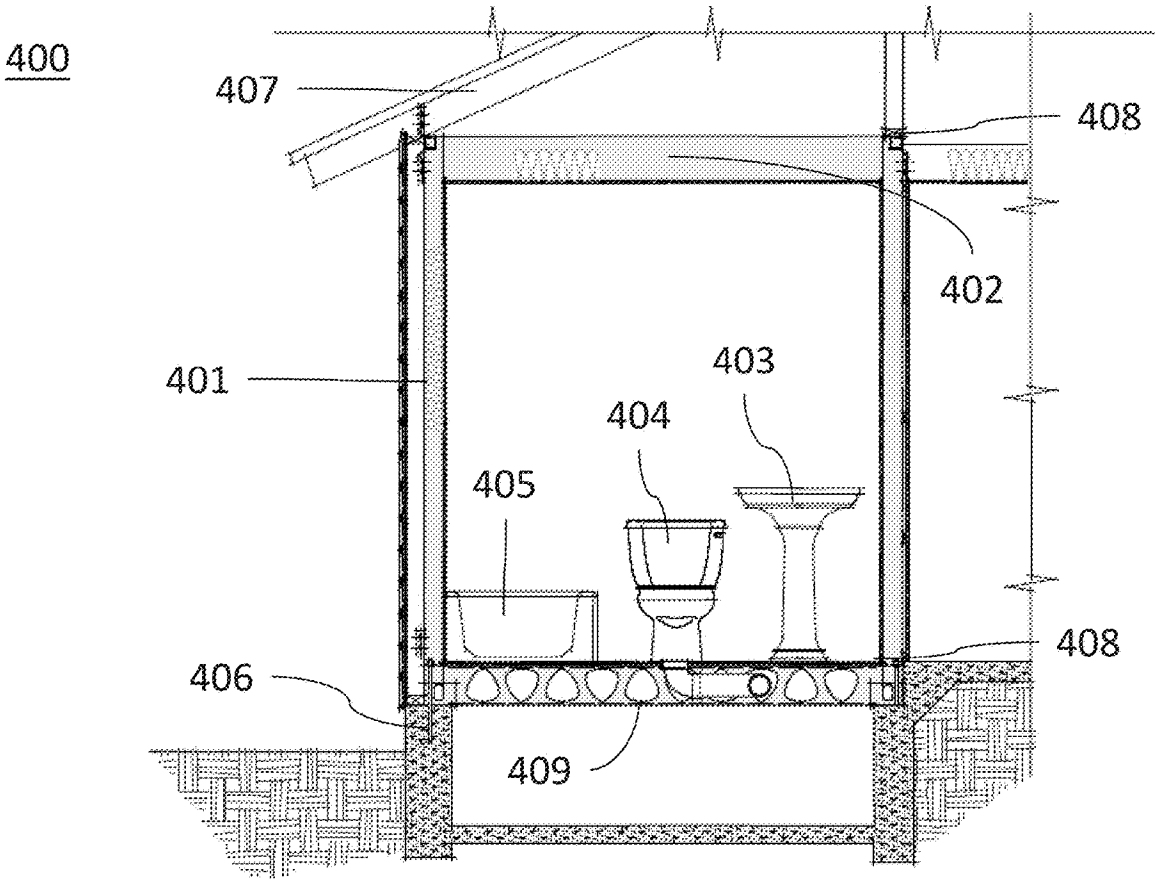
FIG. 4 depicts a cross-section elevational view of a bathroom facility within the core facility of the present invention.

Referencing FIG. 4 the core facility 400 is shown in an exploded elevational view. The wall framing 401 of the core facility may be fully walled, or may be simply framed with outer wall to be finished upon completion of the building construction. Before assembly of the core facility 400, the bracing walls of the wall framing 401 are cold formed by sawing wood into thin strips and planing the wood to a thickness that is even. The strips are stacked and alternated every other strip end for end to reverse the grain slope. A thin layer of adhesive is thinly spread on the face of each strip during the stacking process. Once all of the strips are bonded together by the adhesive making the bracing wall, the bracing wall is placed into a clamping press to compress and dry. Similarly, the top framing 402 may further comprise structural elements, such as bracing, or may contain additional fixtures, wiring or joists for incorporation into the roof or upper floor of a building. In one embodiment exposed framing allows for skilled trades to service and assemble the core facility, including incorporation at the construction site. The core facility may be anchored to the foundation 406 via corner castings 408, which may further aid in the resistance of shear forces. The corner castings described herein are exemplary and any of the anchoring systems mentioned herein may be utilized with the present invention. Following installation of the core facility, the remainder of the building, including the roof 407 may be constructed. The core facility shown in FIG. 4 presents an exemplary bathroom module comprising a bathtub 405, toilet 404 and vanity 403 components. In another embodiment, one or more bathrooms may be assembled as well as kitchen facilities, mechanical room facilities, and the like. In an exemplary embodiment, the core facility comprises a floor diaphragm 409 capable of housing piping and instrumentation, as well as additional support bracing, to be connected to the remainder of the building upon installation.

Figure 5A:
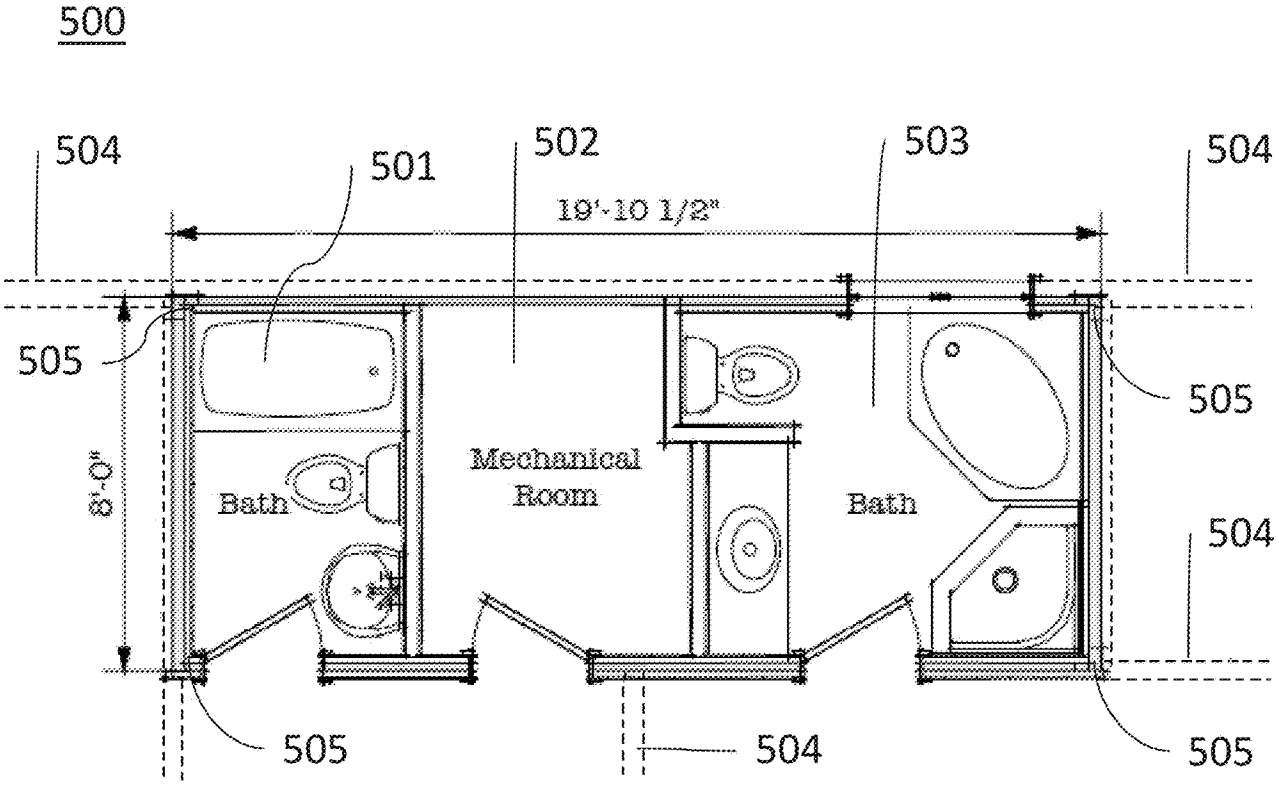
FIG. 5A depicts a top plan view of a core facility of the present invention having a possible arrangement of a two bathroom configuration, within the size envelope of an ISO standard 20 foot intermodal shipping container.
Figure 5B:
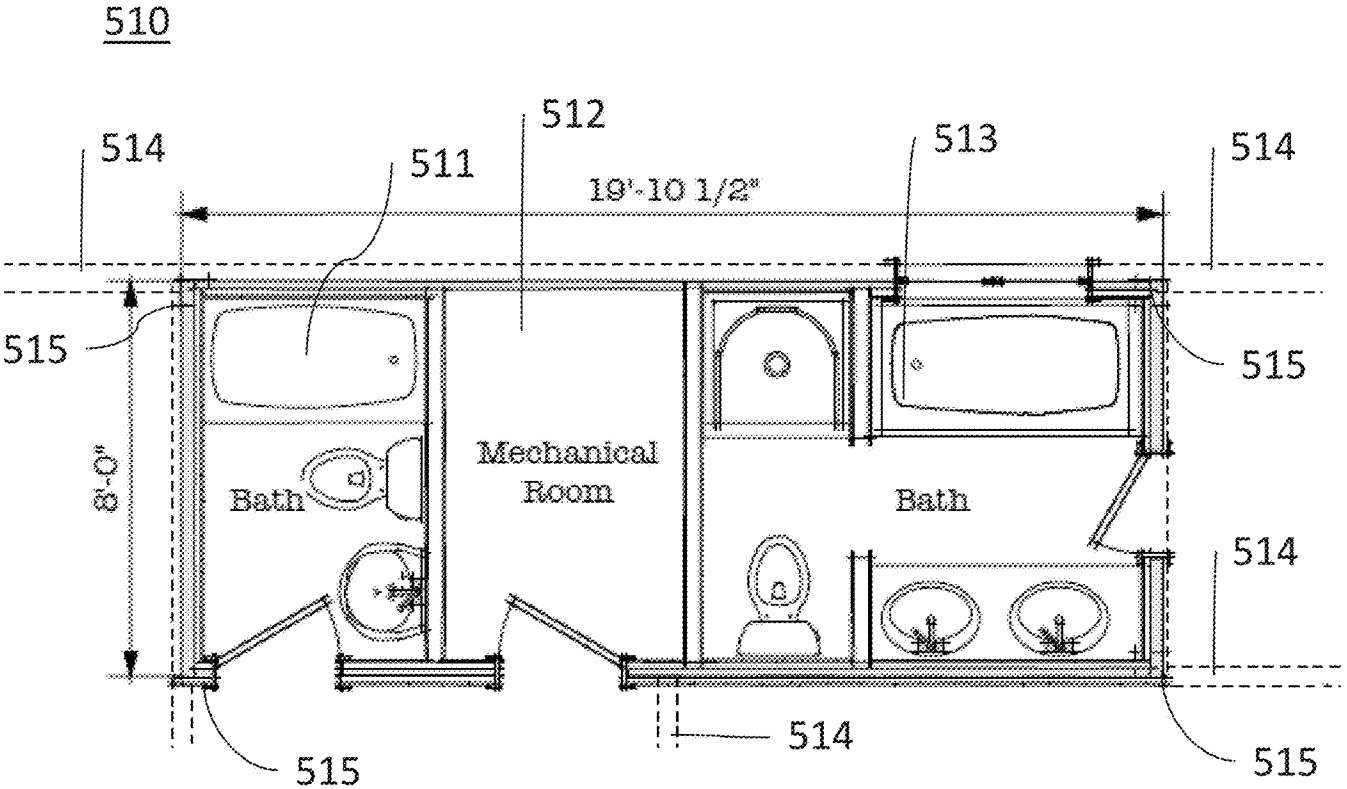
FIG. 5B depicts a top plan view of a core facility having an alternative two-bathroom configuration, within the size envelope of an ISO standard 20 foot intermodal shipping container.
Figure 5C:
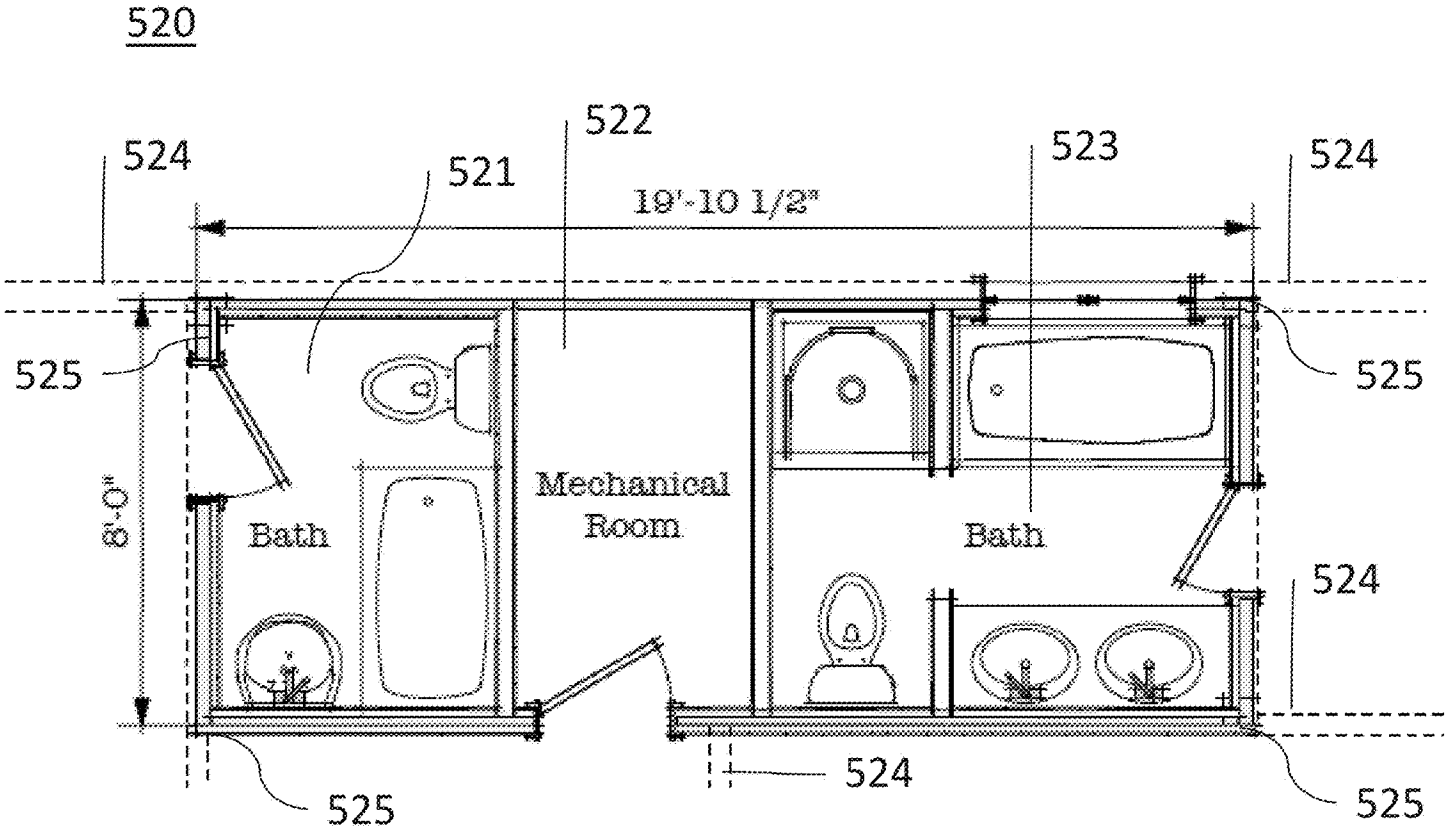
FIG. 5C depicts a top plan view of a core facility having an alternative two-bathroom configuration, within the size envelope of an ISO standard 20 foot intermodal shipping container.

Referencing FIG. 5A-5C, top plan views of varying configurations of the core facility of the present invention are provided. FIG. 5A presents a core facility 500 having two bathroom facilities 501, 503 positioned on opposing ends of the core facility 500. A mechanical room 502 is positioned internally between the bathroom facilities 502, 503. As the core facility 500 is positioned within the building architecture, typical framing 504 may be extended from the core facility 500 to complete the building. The anchor system 505, which may indeed be the corner castings utilized for purposes of intermodal freight transport, are further implemented in anchoring the core facility 500 to the foundation, and further to applicable roof diaphragm and/or bracing walls for purposes of providing shear resistance.

FIG. 5B presents an alternative embodiment of the core facility 510 having two bathroom facilities 511, 513 positioned on opposing ends of the core facility 510. Bathroom facility 513 is presented in an alternative configuration from FIG. 5A, having a double vanity and door configured for end-entry. A mechanical room 512 is again positioned internally between the bathroom facilities 512, 513. Similar to FIG. 5A, the core facility 510 is positioned within the building architecture, typical framing 514 may be extended from the core facility 510 to complete the building. The anchor system 515, which may be corner castings utilized for purposes of intermodal freight transport, can be further implemented in anchoring the core facility 510 to the foundation, and further to applicable roof diaphragm and/or bracing walls for purposes of providing shear resistance.

FIG. 5C presents an alternative embodiment of the core facility 520 having two bathroom facilities 521, 523 positioned on opposing ends of the core facility 520. Bathroom facility 521 is presented in an alternative configuration from FIG. 5B, having a door configured for end-entry similar to bathroom facility 523. A mechanical room 522 is again positioned internally between the bathroom facilities 522, 523. Similar to FIG. 5A and FIG. 5B, the core facility 520 is positioned within the building architecture, typical framing 524 may be extended from the core facility 520 to complete the building. The anchor systems 525, which may be corner castings utilized for purposes of intermodal freight transport, are further implemented in anchoring the core facility 520 to the foundation, and further to applicable roof diaphragm and/or bracing walls for purposes of providing shear resistance.

Figure 6:
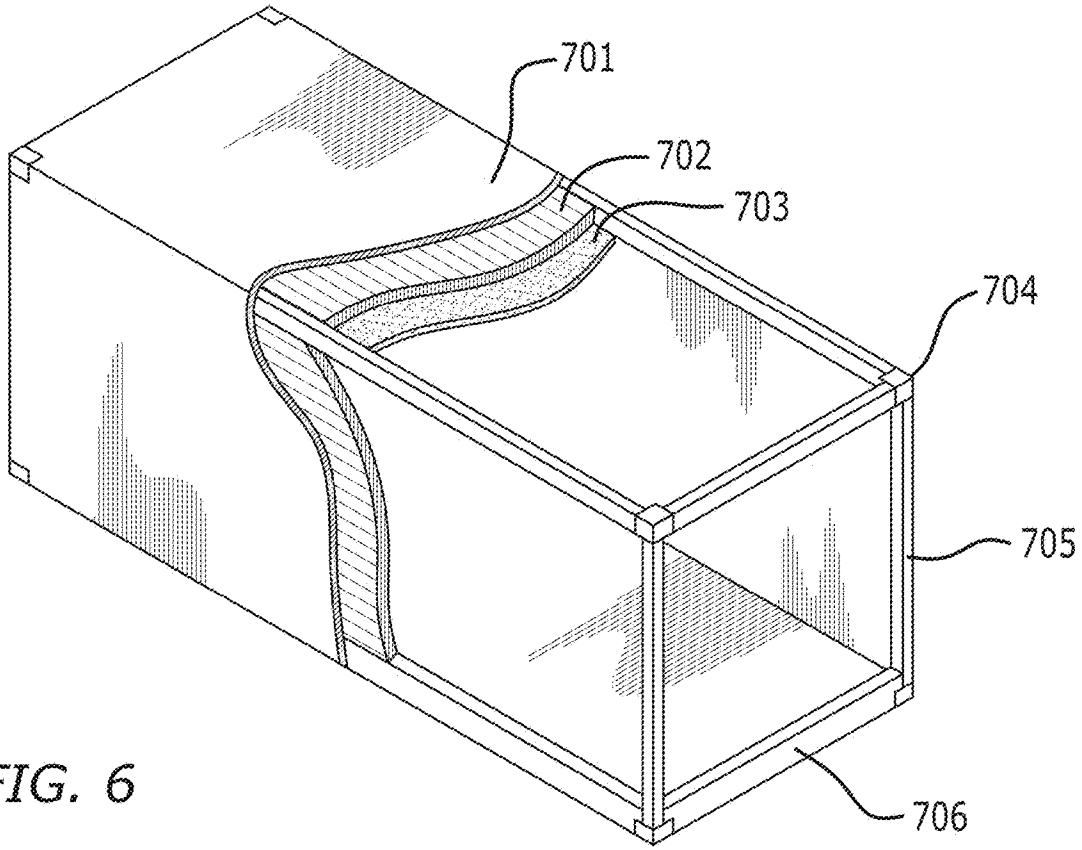
FIG. 6 depicts a top perspective view of a portable core facility having cold formed bracing walls.

FIG. 6 presents a top perspective view of a portable core facility having cold formed bracing walls, wherein an outer skin 701 and inner skin 703 encloses and core 702. The core 702 is comprised of cold formed materials, as described herein. The facility further comprises corner castings 704 positioned in the corner of the core facility, as well as a corner post 705 and bottom rail 706 which support the core facility. The bracing walls comprising the cold formed core 702 may be fully walled prior to delivery to the assembly site, or may be simply framed with outer wall to be finished upon completion of the building construction.

Figure 7:
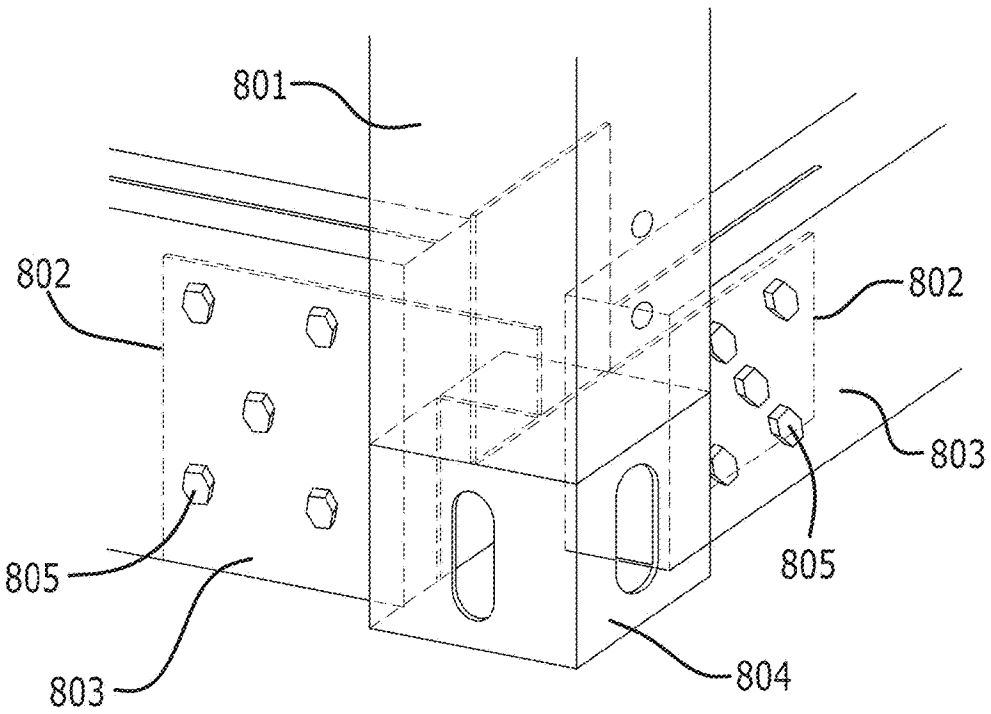
FIG. 7 depicts a top perspective view of a corner casting system utilized with the present invention capable of providing accommodation for engineered timber rails and for anchoring.
Figure 8:
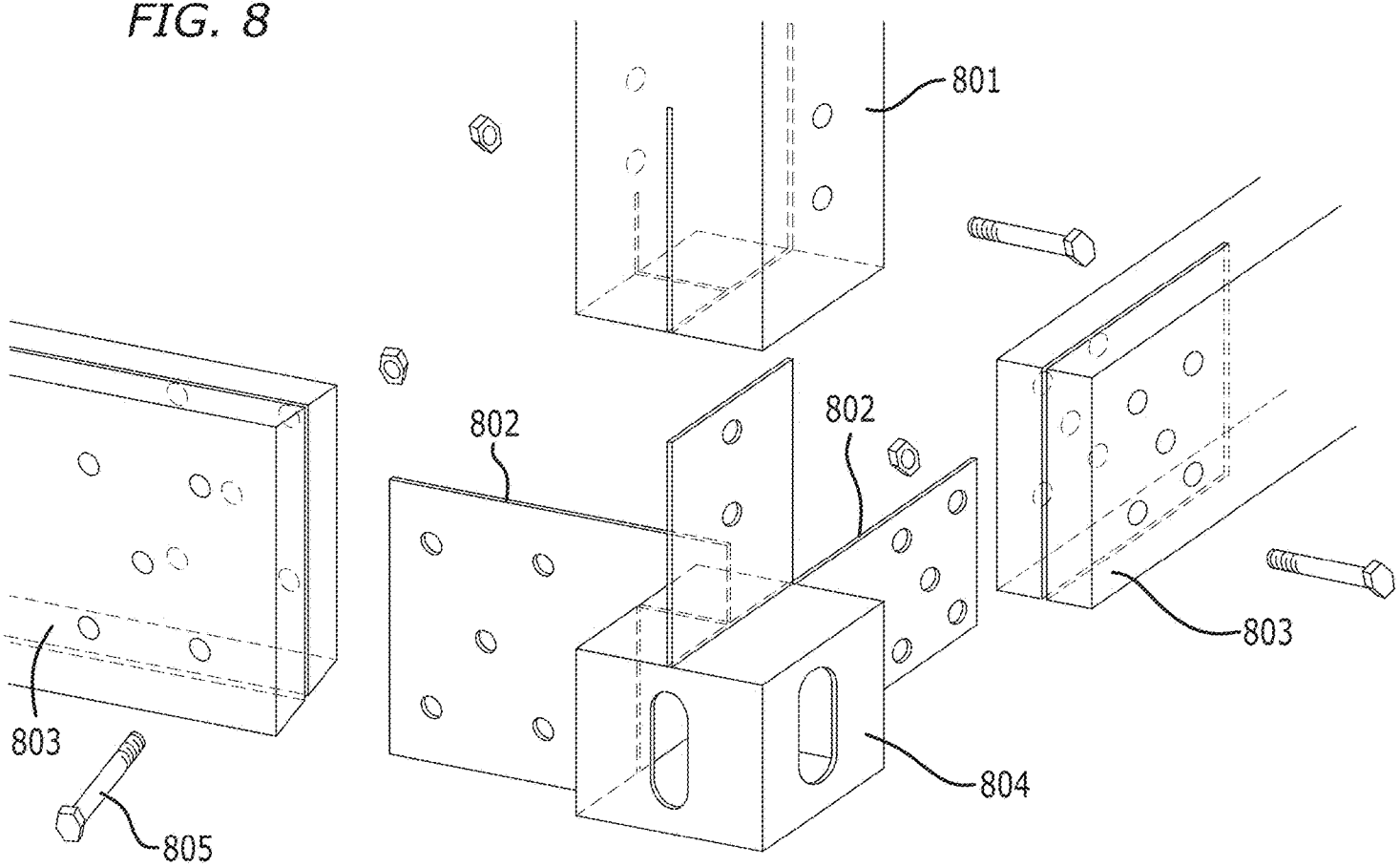
FIG. 8 depicts an exploded view of a corner casting system utilized with the present invention capable of providing accommodation for engineered timber rails and for anchoring.

FIG. 7 presents a top perspective view of a corner casting utilized with the present invention capable of providing accommodation for engineered timber rails and for anchoring. A corner casting 804 capable of being secured for intermodal freight transport, as well as for receiving and supporting a post 801. Plate connectors 802 are affixed to corner casting 804 and are capable of being inserted into a saw cut of a timber rail 803 for further framing. Plate connectors 802 are further fastened with the use of bolts 805 or other fasteners customary in the trade. The plate connectors provide additional shear protection and are further capable of effectively integrating the core facility into the building. Similarly, FIG. 8 presents an exploded view of a corner casting 804 utilized with the present invention capable of providing accommodation for engineered timber rails and for anchoring, as is previously shown in FIG. 7. A corner casting 804 capable of being secured for intermodal freight transport, as well as for receiving and supporting a post 801. Plate connectors 802 are affixed to corner casting 804 and are capable of being inserted into a saw cut of a timber rail 803 for further framing. Plate connectors 802 are further fastened with the use of bolts 805 or other fasteners customary in the trade. The plate connectors provide additional shear protection and are further capable of effectively integrating the core facility into the building.

Those skilled in the art will recognize that the methods and articles of the present invention may be implemented in many manners and as such are not to be limited by the foregoing exemplary embodiments and examples. In other words, functional elements being performed by single or multiple components may be combined into single or multiple embodiments, and alternate embodiments having fewer than, or more than, all of the features described herein are possible.

Functionality may also be, in whole or in part, distributed among multiple components, in manners now known or to become known. Thus, myriad combinations are possible in achieving the functions, features, interfaces and preferences described herein. Moreover, the scope of the present invention covers conventionally known manners for carrying out the described features and functions and interfaces, as well as those variations and modifications that may be made to the construction components and materials as described herein as would be understood by those skilled in the art now and hereafter.

Furthermore, the embodiments of methods presented and described in this disclosure are provided by way of example in order to provide a more complete understanding of the present invention. The disclosed methods are not limited to the operations and logical flow presented herein. Alternative embodiments are contemplated in which the order of the various operations is altered and in which sub-operations described as being part of a larger operation are performed independently. While various embodiments have been described for purposes of this disclosure, such embodiments should not be deemed to limit the teaching of this disclosure to those embodiments. Various changes and modifications may be made to the elements and operations described above to obtain a result that remains within the scope of the systems and processes described in this disclosure.

Alternative embodiments are contemplated in which the order of the various operations is altered and in which sub-operations described as being part of a larger operation are performed independently. While various embodiments have been described for purposes of this disclosure, such embodiments should not be deemed to limit the teaching of this disclosure to those embodiments. Various changes and modifications may be made to the elements and operations described above to obtain a result that remains within the scope of the systems and processes described in this disclosure.

What is claimed is:

1. A portable core facility for a building, comprising:

one or more mechanical rooms;

one or more kitchens;

one or more electrical panels; and one or more bathrooms configured within said portable core facility; wherein said portable core facility further comprises:

a plurality of bracing walls configured as a building module to form a generally rectangular box-like shape having a top, bottom and four sides, and each of the top, bottom and four sides comprises layers of wood strips bonded together; and corner castings located at upper and lower corners of the portable core facility in accordance with standard intermodal shipping containers capable of being transported by an existing intermodal system from a manufacturing facility to a construction site and anchored, via said corner castings, to at least one of a foundation system, a roof or a floor diaphragm, such that each of the bracing walls resist forces in shear and uplift while providing a continuous load path to the foundation system, and each of the corner castings comprises a plurality of plate connectors extending therefrom, and each plate connector is planar and secured to a respective timber rail of the portable core facility.

2. The portable core facility of claim 1, wherein the wood strips of each of the bracing walls are planed to an even thickness, and the wood strips alternate to reverse a slope of a grain of the wood strips.

3. The portable core facility of claim 1, wherein the mechanical room further comprises at least one component selected from the group consisting of: an electrical system, communication systems, one or more hot water heaters, an HVAC system, a water purification system, a washing machine, a dryer, and a utility tub and sink.

4. The portable core facility of claim 1, wherein the one or more kitchens further comprise components selected from a group consisting of: a stove, a refrigerator, a microwave oven, a dishwasher, a counter and cabinets.

5. The portable core facility of claim 1, wherein the one or more bathrooms further comprise at least one component selected from the group consisting of: a toilet, a bidet, a tub, a shower and a sink.

6. The portable core facility of claim 1, further comprising a UL Certified Mark and Barcode attached to the building module for identification.

7. The portable core facility of claim 1, wherein the building module is certified to building codes and standards of a country that the building module will be shipped to.

8. The portable core facility of claim 1, wherein each plate connector is located in a slot in the respective timber rail, and mechanically fastened to the respective timber rail.

9. The portable core facility of claim 1, wherein each bracing wall comprises a core, an outer skin on one side of the core, and an inner skin on an opposite side of the core.

10. A portable core facility for a building, comprising:

bracing walls configured as a building module to form a generally rectangular box-like shape having a top, bottom and four sides, and each of the top, bottom and four sides comprises layers of wood strips bonded together;

corner castings, each located at a respective upper or lower corner of the portable core facility in accordance with standard intermodal shipping containers capable of being transported by an existing intermodal system from a manufacturing facility to a construction site, the corner castings on the lower corners anchor the portable core facility to a foundation system, each corner casing comprises plate connectors that extend therefrom, each plate connector is planar and secured to a respective timber rail of the portable core facility, such that each of the bracing walls resists forces in shear and uplift while providing a continuous load path to the foundation system; and a mechanical room, a kitchen and a bathroom, each configured within the portable core facility.

11. The portable core facility of claim 10, wherein the wood strips of each of the bracing walls are planed to an even thickness, and the wood strips alternate to reverse a slope of a grain of the wood strips.

12. The portable core facility of claim 11, wherein each plate connector is located in a slot in the respective timber rail, and mechanically fastened to the respective timber rail.

13. The portable core facility of claim 12, wherein each bracing wall comprises a core, an outer skin on one side of the core, and an inner skin on an opposite side of the core.

* * * * *